United States Patent [19]

Knaster et al.

[11] Patent Number: 4,563,216

[45] Date of Patent: Jan. 7, 1986

[54] COMPOSITIONS AND PROCESSES FOR COATING FERROUS SURFACES WITH COPPER

[75] Inventors: Mark B. Knaster, Ambler; Carmen M. Carandang, Oaks, both of Pa.

[73] Assignee: Amchem Products, Inc., Ambler, Pa.

[21] Appl. No.: 621,272

[22] Filed: Jun. 15, 1984

[51] Int. Cl.[4] ..... C23C 3/00

[52] U.S. Cl. ..... 106/1.23; 106/1.26; 427/372.2; 427/436

[58] Field of Search ..... 106/1.23, 1.26; 427/436, 372.2

[56] References Cited

U.S. PATENT DOCUMENTS

| | | | |
|---|---|---|---|
| 2,217,921 | 10/1940 | Saukaitis | 106/1.26 |
| 2,410,844 | 11/1946 | Signaigo et al. | 117/130 |
| 3,108,011 | 10/1963 | Frotscher | 117/62.2 |
| 3,432,337 | 3/1969 | Moller et al. | 106/1.23 |
| 3,535,129 | 10/1970 | Oei et al. | 106/1 |
| 3,649,343 | 3/1972 | Reed et al. | 106/1.23 |
| 4,325,990 | 4/1982 | Ferrier | 106/1.26 |

FOREIGN PATENT DOCUMENTS 714437 11/1941 Fed. Rep. of Germany .

927576 5/1963 United Kingdom .

*Primary Examiner*—Lorenzo B. Hayes

*Attorney, Agent, or Firm*—Ernest G. Szoke; Henry E. Millson, Jr.; Mark A. Greenfield

[57] ABSTRACT

Aqueous copper coating compositions, solid compositions for forming the aqueous compositions, and processes for coating the surfaces of ferrous-containing materials by contacting said surfaces with the aqueous copper coating compositions, wherein the aqueous compositions contain:

(a) from about 10 to about 30 grams/liter of cupric ions;

(b) from about 1 to about 10 grams/liter of chloride ions;

(c) from about 0.1 to about 10 grams/liter of at least one aminepolyacetic acid compound; and (d) either (i) from about 0.01 to about 10 grams/liter of acriflavine hydrochloride and from about 0.1 to about 20 grams/liter of a polyalkylene oxide $C_{12}$–$C_{18}$ alkyl or alkenyl amine; or (ii) from about 0.1 to about 10 grams/liter of the reaction product of ortho-toluidine and formaldehyde.

28 Claims, No Drawings

COMPOSITIONS AND PROCESSES FOR COATING FERROUS SURFACES WITH COPPER

This invention relates to immersion processes for providing a copper coating on ferrous-containing materials by contacting the surfaces of such materials with aqueous acidic solutions containing cupric ions. It also relates to said solutions and to novel additives for said solutions to obtain improved copper coatings.

BACKGROUND OF THE INVENTION

The coating of surfaces of ferrous-containing materials, such as, for example, steel and other iron alloys, with copper is well known. This coating may be obtained by electroplating copper from a solution containing cupric ions or by contacting the surface of the ferrous-containing material with an aqueous acidic solution of cupric ions. The latter method, which involves the displacement on the surface of the material of the iron by copper in accordance with the equation $$Fe+Cu^{++}\rightarrow Cu+Fe^{++},$$

does not require the use of an electric current and is simpler to perform.

While apparently simple to carry out, the coating of copper on surfaces of ferrous-containing materials by the non-electrolytic method does present many problems. The reaction itself is relatively rapid, and the copper coating from such rapid reaction is very porous, even mossy, and does not adhere well to the surface. It thus becomes necessary to slow down the rate of reaction by the use of an inhibitor. This inhibitor is added to the aqueous acidic solution containing the cupric ions. By proper control of the rate of the reaction there can be obtained a dense, adherent deposit of copper on the surface of the ferrous-containing material.

A large number of inhibitors are available for this purpose and examples of such inhibitors are disclosed in U.S. Pat. Nos. 2,410,844 and 3,535,129; German Pat. No. 714,437; British Pat. No. 927,576 and French Pat. No. 1,257,758.

It has also been found useful, as disclosed in U.S. Pat. No. 3,535,129, to include surfactants and organic dyes in these coating solutions. The surfactants presumably aid in promoting the contact of the coating solution with the surface of the ferrous-containing material, while the dyes provide added clarity to the coating solution and brighten the appearance of the copper coating. In addition, the dyes may also provide some inhibition of the rate of reaction. However, although these additions do improve the appearance, thickness and adherence of the copper coatings, such improvements tend to apply only to the initial coating—for as the reaction proceeds the later coatings become poorer in quality. This is probably due to the accumulation of ferrous ions and other by-product ions (e.g. $Cl^-$, $SO_4^=$) in the coating solution from the above reaction.

DESCRIPTION OF THE INVENTION

It is, accordingly, an object of this invention to provide an inhibitor composition to be added to an aqueous acidic solution of cupric acid, which will provide a copper coating of good quality during the entire period of the coating operation.

It is another object of this invention to provide an inhibitor composition which is multifunctional in that it provides good wetting by the solution and results in formation of bright copper coatings, even in the presence of high concentration of ferrous ions in the solution.

It is a further object of this invention to provide a process for the preparation of said multifunctional inhibitor composition.

It is still another object of this invention to provide improved processes for the coating of copper on surfaces of ferrous-containing materials and compositions for use in said processes.

There has now been discovered processes and inhibitor compositions that produce a copper coating on ferrous-containing materials that are superior to those of the prior art in that the coatings extend die life beyond present limits and produce bright, adherent copper coatings continually, irrespective of the build up of contaminants that typically occur in an electroless copper depositing bath under production conditions.

The inhibitor compositions of the invention are set forth below:

| | Composition I | |
|---|---|---|
| Component | Broad range approximate parts by weight | Preferred range approximate parts by weight |
| $Cu^{++}$ | 10–30 | 17–19 |
| $Fe^{++}$ | 0–20 | 4–5 |
| $Cl^-$ | 1–10 | 2–4 |
| Acriflavine hydrochloride | 0.01–10 | 0.05–3 |
| Polyalkylene oxide $C_{12}$—$C_{18}$ alkyl or alkenyl | 0.1–20 | 1–10 |
| Aminepolyacetic acid compound | 0.1–10 | 0.1–0.5 |

In the above Composition I, the cupric ion can be provided by any cupric compound, provided it does not have a strong oxidizing action. Cupric sulfate is particularly useful herein, although the oxide, chloride, nitrate, acetate, or benzoate can also be employed.

The ferrous ion, which is an optional but preferred ingredient, can be provided by ferrous sulfate, although the anions used with the cupric ion also form suitable ferrous salts as well.

The chloride ion can be provided in whole or in part by the cupric and/or ferrous chlorides. Also, alkali metal chlorides can also be used, e.g. NaCl or KCl.

The acriflavine hydrochloride is a mixture of the hydrochlorides of 3,6-diamino-10-methylacridinium chloride and 3,6-diaminoacridine.

The polyalkylene oxide $C_{12}$–$C_{18}$ alkyl or alkenyl amine is a hydrophilic compound having from 3 to 70, preferably from 5 to 30 polyalkyleneoxide groups. Such amine can be either of the following two types:

1. the reaction product of water soluble polyamines containing polyalkylene oxide groups attached to the nitrogen atom and having in the molecule more than one reactive hydrogen atom attached to a nitrogen atom and compounds containing more than one epoxide and/or halohydrin radicals, followed by reaction with a partially sulfonated $C_{12}$–$C_{18}$ fatty alcohol. Such reaction products are disclosed in U.S. Pat. No. 3,108,011 to Frotscher et al, see particularly the operating examples, for the treatment of textiles, and the disclosure of this patent is specifically incorporated herein by reference. Such products are also available commercially from Henkel Corporation under the "POLYQUART" trademarks, e.g. POLYQUART H (PEG-15 Tallow Polyamine) and POLYQUART H-7102 (PEG-15 Cocopolyamine and Stearalkonium Chloride). PEG-15 tallow polyamine (POLYQUART H) is preferred for use herein.

2. polyoxyethylated $C_{12}$–$C_{18}$ alkyl or alkenyl amines. Examples thereof include polyoxyethylated (30) oleyl amine, polyoxyethylated (5) tallow amine, polyoxyethylated (15) tallow amine, etc. Such compounds are commercially available under the trademark "KATAPOL" by GAF Corporation.

The aminepolyacetic acid compound can be a single acid or a mixture of two or more acids. The acids can be employed as such or in the form of their alkali metal salts, e.g. the sodium or potassium salts. Examples thereof include ethylenediaminetetracetic acid (EDTA) and its tetrasodium salt, trisodium nitriloacetate, and trisodium N-(hydroxyethyl)ethylenediaminetriacetate. The above compounds are commercially available under the CHEELOX trademark by the GAF Corporation. EDTA and its tetrasodium salt are preferred for use herein.

| | Composition II | |
|---|---|---|
| Component | Broad range approximate parts by weight | Preferred range approximate parts by weight |
| $Cu^{++}$ | 10-30 | 17-19 |
| $Fe^{++}$ | 0-20 | 4-5 |
| $Cl^-$ | 1-10 | 2-4 |
| Reaction product or ortho-toluidine and formaldehyde | 0.1-10 | 0.1-0.5 |
| Aminepolyacetic acid derivative | 0.1-10 | 0.1-0.5 |

In the above Composition II formulations, the nature and sources of $Cu^{++}$, $Fe^{++}$, $Cl^-$, and aminepolyacetic acid derivative are identical to those of Composition I.

The reaction product of ortho-toluidine and formaldehyde is the reaction product of (i) from about 350 to about 450 parts, preferably from about 370 to about 420 parts by weight of ortho-toluidine, and (ii) from about 110 to about 130 parts, preferably from about 105 to about 120 parts by weight of formladehyde.

The Composition II formulation can be obtained by mixing the above relative quantities of ortho-toluidine and formaldehyde or a source of formaldehyde such as an aqueous solution thereof, optionally with up to about 30 parts, preferably from about 25 to about 28 parts, of sulfamic acid, as a reaction catalyst, until a highly viscous, waxy, material is obtained, adding with mixing the amine polyacetic acid derivative to the mixture containing the waxy material reaction product of o-toluidine and formaldehyde and, optionally, the sulfamic acid, and heating the resultant mixture at about 180° to about 195° F., preferably about 185° to about 190° F., for about 30 to about 50 minutes. Then the sources of $Cu^{++}$, $Fe^{++}$, and $Cl^-$ are added with mixing. After cooling, the resultant solid is ground into a fine powder.

If sulfamic acid is not used, the aminepolyacetic acid derivative is added directly to the waxy reaction product of o-toluidine and formaldehyde, and the process continued as described above except that 2 to 3 times more mixing and heating time is required to obtain the final product.

While any source of formaldehyde (e.g. paraformaldehyde or formalin) may be used to provide the formaldehyde, it is preferred to use formalin, which is an aqueous solution of formaldehyde containing about 37% by weight of formaldehyde.

Improved copper coating compositions of this invention include aqueous acidic compositions having a pH of about 0.2 to about 1.0, preferably about 0.45 to about 0.55, prepared by adding Composition I or II to water and acidifying as required with sulfuric acid. The aqueous coating compositions are prepared by adding Composition I or II in quantity sufficient to give from about 2.5 to about 10.0 g/l, preferably from about 4.0 to about 9.0 g/l, of $Cu^{++}$.

Other ingredients such as sodium ions can be added or can enter the aqueous solution during the coating operation without impairing its functionality and good coating properties.

The above aqueous solutions can be used for coating copper on the surfaces of ferrous-containing materials using any conventional technique, although dipping or immersion techniques are preferred. The coating operation is preferably carried out at a temperature of about 95° to about 130° F. for about 1 to about 5 minutes. The surface to be coated is cleaned prior to coating using suitable cleaning techniques such as alkaline degreasing and pickling.

The copper coating solutions of the invention have a number of significant advantages over known copper coating solutions. The inhibitors in prior art solutions "tar-out" at high ferrous ion, chloride ion, or acid concentrations. The present solutions provide excellent die life and permit faster wire-drawing they have a low chloride ion content and therefore provide longer tank life. They contain chelating agents that stabilize the ferrous ions in the bath. In addition, they provide a minimum of user environmental problems. Furthermore, the polyalkylene oxide $C_{12}$–$C_{18}$ alkyl or alkenyl amine present in inhibitor Composition I provides additional lubricity to the copper coated wire that further extends die life.

The invention will be made clearer from the examples which follow. These examples are given by way of illustration and are not to be regarded as limiting.

EXAMPLE 1

Preparation of a mixture of the reaction product of ortho-toluidine and formaldehyde, and ethylenediaminetetraacetic acid. To 306 g of o-toluidine, 112 g of formaldehyde (as 306 g of a 37% aqueous solution of formaldehyde) were added slowly with stirring and the stirring continued until a highly viscous, waxy material was formed. After the formation of the viscous, waxy material the remaining liquid containing unreacted material was discarded. To this viscous waxy material 26 g of sulfamic acid was added with suitable stirring until the mixture became substantially homogeneous. To this resultant mixture 552 g of ethylenediaminetetraacetic acid was added with stirring and the stirring was continued while the mixture was heated at 185° to 190° F. for 30 to 50 minutes. The mixture was allowed to cool and ground into a fine powder. This mixture was then added to water, together with the other ingredients of the aqueous copper coating solutions, in the quantities given in the following examples. The solutions of the following examples produce a high quality copper coating on the surface of ferrous-containing materials without the need for using other supportive agents such as surfactants, dyes and other chelating agents.

Examples 2 to 5 illustrate the use of the above mixture in coating operations.

EXAMPLE 2

Non-annealed low carbon welding wire (Type ER70S-30, American Welding Society) was first cleaned with a 15% by weight aqueous solution of hydrochloric acid at 40° C. (104° F.), rinsed in cold tap water, and immersed for 2 minutes in a copper coating solution at 110° F. containing:

21 g/l copper sulfate
1.0 g/l sodium chloride
1.0 g/l ferrous sulfate
1.0 g/l of the mixture prepared in Example 1
42 g/l93% sulfuric acid After immersion, the workpieces were rinsed with water and dried. All of the wires were found to have a bright, uniform copper coating, with good adhesion of the copper to the steel surface. Adhesion was checked by wrapping coated wires around a stainless rod having a diameter of ⅛". Examination with a magnifying glass (4×) indicated that the samples of the wire did not show any damage (peeling, cracking, etc.) to the coating which retained its bright copper color.

EXAMPLE 3

The procedure of Example 2 was repeated with the exception that the concentration of the mixture prepared in Example 1 was increased to 15 g/l. The results were the same as in Example 2.

EXAMPLE 4

The procedure of Example 2 was repeated with the exception that the concentration of copper sulfate was 15 g/l, sodium chloride 4.1 g/l and ferrous sulfate 450 g/l. The results were the same as in Examples 2 and 3. This example shows that even where the quantity of ferrous ion far exceeds both the broad and preferred ranges, which may occur upon continued formation of ferrous ions from ferrous based welding wires, the present copper coating solutions remain fully functional.

EXAMPLE 5

The procedure of Example 4 was repeated with the exception that the concentration of inhibitor was 15 g/l. The results were the same as in Examples 2 to 4.

Samples of wires from Examples 2 to 5 were tested for coating weight. The results of these tests are presented in Table 1 below:

TABLE 1

| Type of Wire (low carbon steel) | diameter of Wire (inches) | Weight of Copper Coating on Wire in mg/ft² from Examples 2 to 5 | | | |
|---|---|---|---|---|---|
| | | 2 | 3 | 4 | 5 |
| S-6 | 0.086 | 643 | 570 | 585 | 510 |
| S-3 | 0.078 | 611 | 535 | 552 | 507 |

The above table shows that excellent coating weights are obtained by the process and compositions of the invention. The quality of the coatings set forth in the above Table 1 were all excellent.

EXAMPLE 6

It was discovered that during processing the best results were achieved when the copper-coating bath parameters are altered as the build-up of ferrous iron in the bath occurs. It was determined that a copper-coating bath containing:

| Component | Concentration (g/l) |
|---|---|
| Cupric ions | about 4.0 to about 9.0 |
| Chloride ions | about 0.1 to about 3.5 |
| Sulfate ions | about 6.0 to about 12.0 |
| Acriflavine hydrochloride | about 0.03 to about 0.15 |
| Tetrasodium ethylene diamine tetracetate dihydrate | about 0.02 to about 0.1 |
| Polyethylene glycol-15 tallow polyamine (POLYQUART H, Henkel Corporation) | about 0.6 to about 7.5 |

and containing 2.5% v/v concentrated sulfuric acid (93% wt/wt) for acidity adjustment, was optimized by changes in the acidity, temperature, and copper content as shown in Table 2 below.

TABLE 2

| INGREDIENT QUANTITIES | | | | | | TEMPERATURE | |
|---|---|---|---|---|---|---|---|
| Ferrous ions, g/l | | Cupric ions, g/l | | Sulfuric acid equivalency, g/l | | | |
| From | To | From | To | From | To | °F. | °C. |
| 0 | 27 | 5.5 | 5.7 | 42.6 | 44.5 | 110–112 | 43–44 |
| 27 | 45 | 5.7 | 6.0 | 44.5 | 46.5 | 112–115 | 44–46 |
| 45 | 63 | 6.0 | 6.5 | 46.5 | 51.5 | 115–118 | 46–48 |
| 63 | 76.5 | 6.5 | 7.3 | 51.5 | 59.4 | 118–124 | 48–51 |
| 76.5 | 85.5 | 7.3 | 8.3 | 59.4 | 63.4 | 124–129 | 51–54 |

EXAMPLE 7

Another example of an operating bath that provided excellent results in the presence of ferrous ion was made up as follows:

| Components | Bath Composition (g/l) |
|---|---|
| Cupric Ion | 7.3 |
| Chloride Ion | 0.4 |
| Ferrous Ion | 28.0 |
| Acriflavine Hydrochloride | 0.09 |
| POLYQUART H | 3.4 |
| EDTA (Sodium Salt) | 0.09 |
| Sulfuric Acid (equivalence) | 48.5 |

With this bath, a copper coating weight of 1580 mg/ft² was obtained on Type S-3 wire, which had excellent brightness and drawing quality.

What is claimed:

1. An aqueous copper coating composition, for coating the surfaces of ferrous-containing materials by contacting said surfaces with said composition, said composition comprising:

(a) from about 10 to about 30 grams/liter of cupric ions;
(b) from about 1 to about 10 grams/liter of chloride ions;
(c) from about 0.1 to about 10 grams/liter of at least one aminepolyacetic acid compound; and
(d) either
  (i) from about 0.01 to about 10 grams/liter of acriflavine hydrochloride and from about 0.1 to about 20 grams/liter of a polyalkylene oxide $C_{12}$–$C_{18}$ alkyl or alkenyl amine; or
  (ii) from about 0.1 to about 10 grams/liter of the reaction product of ortho-toluidine and formaldehyde.

2. An aqueous copper coating composition in accordance with claim 1 wherein component (a) is present in from about 17 to about 19 grams/liters; component (b) is present in from about 2 to about 4 grams/liter; and component (c) is present in from about 0.1 to about 0.5 grams/liter.

3. An aqueous copper coating composition in accordance with claim 2 wherein component (d) (i) is present in from about 1 to about 10 grams/liter of acriflavine hydrochloride and from about 1 to about 10 grams/liter of polyalkylene oxide $C_{12}$–$C_{18}$ alkyl or alkenyl amine.

4. An aqueous copper coating composition in accordance with claim 2 wherein component (d) (ii) is present in from about 0.1 to about 0.5 grams/liter of the reaction product of ortho-toluidine and formaldehyde.

5. An aqueous copper coating composition in accordance with claim 1 wherein up to about 20 grams/liter of ferrous ion is present.

6. An aqueous copper coating composition in accordance with claim 1 wherein component (c) is one or more of the following: EDTA, tetrasodium salt of EDTA, nitriloacetic acid, trisodium nitriloacetate, N-(hydroxyethyl)ethylenediaminetriacetic acid, and the trisodium salt of N-(hydroxyethyl)ethylenediaminetriacetic acid.

7. An aqueous copper coating composition in accordance with claim 1 wherein in (d) (i) the polyalkylene oxide $C_{12}$–$C_{18}$ alkyl or alkenyl amine is the reaction product of a partially sulfonated $C_{12}$–$C_{18}$ fatty alcohol and a compound resulting from the reaction between a water soluble polyamine containing polyalkylene oxide groups attached to the nitrogen atom and having in the molecule more than one reactive hydrogen atom attached to a nitrogen atom and a compound containing more than one epoxide group or halohydrin group, or both such groups.

8. An aqueous copper coating composition in accordance with claim 1 wherein in (d) (i) the polyalkylene oxide $C_{12}$–$C_{18}$ alkyl or alkenyl amine is a polyoxyethylated $C_{12}$–$C_{18}$ alkyl or alkenyl amine.

9. An aqueous copper coating composition in accordance with claim 1 wherein in (d) (ii) the reaction product of ortho-toluidine and formaldehyde is the reaction product of from about 350 to about 450 parts by weight of ortho-toluidine and from about 110 to about 130 parts by weight of formaldehyde.

10. A solid composition, for use in forming aqueous copper coating compositions, comprising:

(a) from about 10 to about 30 parts by weight of cupric ions;
(b) from about 1 to about 10 parts by weight of chloride ions;
(c) from about 0.1 to about 10 parts by weight of at least one aminepolyacetic acid compound; and
(d) either
  (i) from about 0.01 to about 10 parts by weight of acriflavine hydrochloride and from about 0.1 to about 20 parts by weight of a polyalkylene oxide $C_{12}$–$C_{18}$ alkyl or alkenyl amine; or
  (ii) from about 0.1 to about 10 parts by weight of the reaction product of ortho-toluidine and formaldehyde.

11. A solid composition in accordance with claim 10 wherein component (a) is present in from about 17 to about 19 parts by weight; component (b) is present in from about 2 to about 4 parts by weight; and component (c) is present in from about 0.1 to about 0.5 parts by weight.

12. A solid composition in accordance with claim 11 wherein component (d) (i) is present in from about 1 to about 10 parts by weight of acriflavine hydrochloride and from about 1 to about 10 parts by weight of polyalkylene oxide $C_{12}$–$C_{18}$ alkyl or alkenyl amine.

13. A solid composition in accordance with claim 11 wherein component (d) (ii) is present in from about 0.1 to about 0.5 parts by weight of the reaction product of ortho-toluidine and formaldehyde.

14. A solid composition in accordance with claim 10 wherein up to about 20 parts by weight of ferrous ion is present.

15. A solid composition in accordance with claim 10 wherein component (c) is one or more of the following: EDTA, tetrasodium salt of EDTA, nitriloacetic acid, trisodium nitriloacetate, N-(hydroxyethyl)ethylenediaminetriacetic acid, and the trisodium salt of N-(hydroxyethyl)ethylenediaminetriacetic acid.

16. A solid composition in accordance with claim 10 wherein in (d) (i) the polyalkylene oxide $C_{12}$–$C_{18}$ alkyl or alkenyl amine is the reaction product of a partially sulfonated $C_{12}$–$C_{18}$ fatty alcohol and a compound resulting from the reaction between a water soluble polyamine containing polyalkylene oxide groups attached to the nitrogen atom and having in the molecule more than one reactive hydrogen atom attached to a nitrogen atom and a compound containing more than one epoxide group or halohydrin group, or both such groups.

17. A solid composition in accordance with claim 10 wherein in (d) (i) the polyalkylene oxide $C_{12}$–$C_{18}$ alkyl or alkenyl amine is a polyoxyethylated $C_{12}$–$C_{18}$ alkyl or alkenyl amine.

18. A solid composition in accordance with claim 10 wherein in (d) (ii) the reaction product, of orthotoluidine and formaldehyde is the reaction product of from about 350 to about 450 parts by weight of ortho-toluidine and from about 110 to about 130 parts by weight of formaldehyde.

19. A process for coating the surface of a ferrous metal substrates comprising contacting said surface with a composition comprising:

(a) from about 10 to about 30 grams/liter of cupric ions;
(b) from about 1 to about 10 grams/liter of chloride ions;
(c) from about 0.1 to about 10 grams/liter of at least one aminepolyacetic acid compound; and
(d) either
  (i) from about 0.01 to about 10 grams/liter of acriflavine hydrochloride and from about 0.1 to about 20 grams/liter of a polyalkylene oxide $C_{12}$–$C_{18}$ alkyl or alkenyl amine; or
  (ii) from about 0.1 to about 10 grams/liter of the reaction product of ortho-toluidine and formaldehyde.

20. A process in accordance with claim 19 wherein component (a) is present in from about 17 to about 19 grams/liter; component (b) is present in from about 2 to about 4 grams/liter; component (c) is present in from about 0.1 to about 0.5 grams/liter.

21. A process in accordance with claim 20 wherein component (d) (i) is present in from about 1 to about 10 grams/liter of acriflavine hydrochloride and from about 1 to about 10 grams/liter of polyalkylene oxide $C_{12}$–$C_{18}$ alkyl or alkenyl amine.

22. A process in accordance with claim 20 wherein component (d) (ii) is present in from about 0.1 to about 0.5 grams/liter of the reaction product of ortho-toluidine and formaldehyde.

23. A process in accordance with claim 19 wherein up to about 20 grams/liter of ferrous ion is present.

24. A process in accordance with claim 19 wherein component (c) is one or more of the following: EDTA, tetrasodium salt of EDTA, nitriloacetic acid, trisodium nitriloacetate, N-(hydroxyethyl)ethylenediaminetriacetic acid, and the trisodium salt of N-(hydroxyethyl)ethylenediaminetriacetic acid.

25. A process in accordance with claim 19 wherein in (d) (i) the polyalkylene oxide $C_{12}$–$C_{18}$ alkyl or alkenyl amine is the reaction product of a partially sulfonated $C_{12}$–$C_{18}$ fatty alcohol and a compound resulting from the reaction between a water soluble polyamine containing polyalkylene oxide groups attached to the nitrogen atom and having in the molecule more than one reactive hydrogen atom attached to a nitrogen atom and a compound containing more than one epoxide group or halohydrin group, or both such groups.

26. A process in accordance with claim 19 wherein in (d) (i) the polyalkylene oxide $C_{12}$–$C_{18}$ alkyl or alkenyl amine is a polyoxyethylated $C_{12}$–$C_{18}$ alkyl or alkenyl amine.

27. A process in accordance with claim 19 wherein in (d) (ii) the reaction product of ortho-toluidine and formaldehyde is the reaction product of from about 350 to about 450 parts by weight of ortho-toluidine and from about 110 to about 130 parts by weight of formaldehyde.

28. A process in accordance with claim 19 wherein the contacting is carried out at a temperature of from 95° to about 130° F.

* * * * *